US005816141A

United States Patent [19]

Aylsworth et al.

[11] Patent Number: 5,816,141

[45] Date of Patent: Oct. 6, 1998

[54] VERTICAL DOOR BALER WITH TAB AND SLOT CONSTRUCTION

[75] Inventors: Steven L. Aylsworth, Chatfield; Bryan A. Fisher, Harmony, both of Minn.

[73] Assignee: Excel Manufacturing, St. Charles, Minn.

[21] Appl. No.: 402,897

[22] Filed: Mar. 13, 1995

[51] Int. Cl.[6] ..... B30B 9/30

[52] U.S. Cl. ..... 100/25; 100/214; 100/249

[58] Field of Search ..... 100/214, 240, 100/242, 249, 252, 295, 25; 220/617, 682, 690

[56] References Cited

U.S. PATENT DOCUMENTS

| | | | |
|---|---|---|---|
| 1,284,756 | 11/1918 | O'Donnell | 100/295 |
| 1,355,213 | 10/1920 | Chipperfield | 220/690 |
| 1,990,839 | 2/1935 | Power | 100/252 |
| 2,530,849 | 11/1950 | Wyatt et al. | 220/682 |
| 4,476,780 | 10/1984 | Bunch | 100/214 |

FOREIGN PATENT DOCUMENTS

| | | | |
|---|---|---|---|
| 4898 | 6/1902 | Denmark | 100/242 |
| 2208682 | 8/1973 | Germany | 100/249 |
| 3010521 | 9/1981 | Germany | 100/295 |
| 48107 | 11/1964 | Poland | 100/252 |
| 2064424 | 6/1981 | United Kingdom | 100/249 |

*Primary Examiner*—Stephen F. Gerrity
*Attorney, Agent, or Firm*—Hugh D. Jaeger

[57] ABSTRACT

A baler for compression and baling of waste including a ram and a reinforced vertically sliding bale chamber door at one end of a baler chamber. Tab and slot construction provide for interlocking of heavy wall components and associated members and for component self-alignment and location during fabrication. Extensive support by heavy gauge interlocking cross stringers, longitudinal stringers, and other interlocking support members, provides for operational and geometric stability of the mechanical chamber, the charge or gather chamber, the bale chamber, and the vertically sliding bale chamber door during compression and ejection of waste.

3 Claims, 18 Drawing Sheets

MACHINE OPERATION

1. Read and understand owners manual and machine functions.

2. All safety devices and panels must be functional and in place.

3. Turn power disconnect control 362 to "on" position.

4. Turn and hold key switch included in control 362 to "start" position until buzzer stops and motor 322 is running. Return key switch control 362 to "on" position.

DANGER - Machine may cycle automatically at this point! See owners manual.

5. Turn hand/auto selector control switch 364 to "auto." Push reverse control button 368 to initialize auto operation.

6. Load charge chamber 14 until full.

DANGER - Before pushing cycle button, clear personnel from area. Operator must be at least 18 years old.

7. For auto cycle operation, turn photoeye selector control switch 366 to "on" position or push "forward" control button 370 to cycle machine.

8. Return to step #6 until tie light 380 has illuminated. Upon illumination, see "bale ejection" sequence.

BALE EJECTION SEQUENCE

1. Machine has stopped with the light 380 illuminated.

2. Turn hand/auto selector control switch 364 to "hand" and tie off bale. See owners manual.

3. Push reverse control button 368 and retract platen off bale.

DANGER - Clear ejection area.

4. Push and hold raise control button 374 until door 18 stops.

5. Push forward control button 370 until bale is fully ejected and removed from machine.

DANGER - Clear ejection area, check for obstructions--clear personnel.

6. Push lower control button 376 until door 18 stops.

7. To continue auto operation, return to step #5 of "Machine Operation" instructions.

FIG. 15

VERTICAL DOOR BALER WITH TAB AND SLOT CONSTRUCTION

BACKGROUND OF THE INVENTION

1. Field of the Invention

The present invention is for a baler, and more particularly, pertains to a baler with interlocking tab and slot fabrication in the main baler body and in the vertically positionable sliding bale door which is utilized in the fabrication process.

2. Description of the Prior Art

While prior art balers performed the function of baling waste, problems were encountered subsequent to lengthy or abusive use of the baling device, such as attempting to compress an excessive amount of material into a volumetric area of questionable strength which caused warpage and distortion of the geometry of a baler's physical geometric alignment. Such misalignment, of course, manifested itself in jamming of the ram, or breakage of the ram components or of enclosure components. Clearly, what is needed is a baler constructed to stand up to the rigors of lengthy use or even various baler abuses which will not distort the geometric alignment.

The present invention provides such a baler of heavy wall reinforced construction featuring interlocking tab and slot construction which is self-aligning and self-locating during the fabrication process with additional interlocking vertical and cross stringer reinforcement to obtain maximum structural integrity.

SUMMARY OF THE INVENTION

The general purpose of the present invention is a baler of reinforced tab and slot construction having a reinforced vertically sliding door at one end of the bale chamber.

According to one embodiment of the present invention there is provided a baler including a centrally located charge or gather chamber, a mechanical chamber aligned to one end of the centrally located charge or gather chamber, a charge hopper aligned to the top of the centrally located charge or gather chamber, a bale chamber located and aligned at one end of the charge or gather chamber, a power unit, a rear cover, a reinforced vertically sliding bale chamber door, a plurality of interlocking stringers having vertical and/or horizontal members aligned to the mechanical chamber and charge or gather chamber, and various other structural members.

One significant aspect and feature of the present invention is a baler having extreme structural geometric stability including incorporation of tabs and slots to align and join planar side, top and bottom members.

Another significant aspect and feature of the present invention is the utilization of precision cut tab and slot members which self-align and locate without the use of external jigs, forms or other supports to provide for rapid and more economical fabrication.

Another significant aspect and feature of the present invention is the utilization of sides having slots which align and fit into corresponding tab members extending from a planar bottom member.

Another significant aspect and feature of the present invention is the utilization of U-shaped plate members aligned about the upper region members and side members which engage slots in the side and bottom plate members to provide for mechanical, charge or gather and bale chamber geometric stability.

Yet another significant aspect and feature of the present invention is the slot and tab mounting of a ram support bracket to the surrounding structure.

Another object of the present invention is a baler of interlocking self-aligning and self-locating tab and slot construction which is utilized in the fabrication process.

Another significant aspect and feature of the present invention is the utilization of a vertically positionable reinforced door at one end of the bale chamber.

Another significant aspect and feature of the present invention is the utilization of interlocking slot construction of the sliding bale chamber door.

Having thus described embodiments of the present invention, it is the principal object of the present invention to provide a baler with interlocking component structure having a reinforced sliding bale chamber door.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein:

FIG. 15 illustrates the alignment of FIGS. 17A and 17B;

DETAILED DESCRIPTION OF THE PREFERRED EMBODIMENTS

Figure 1:
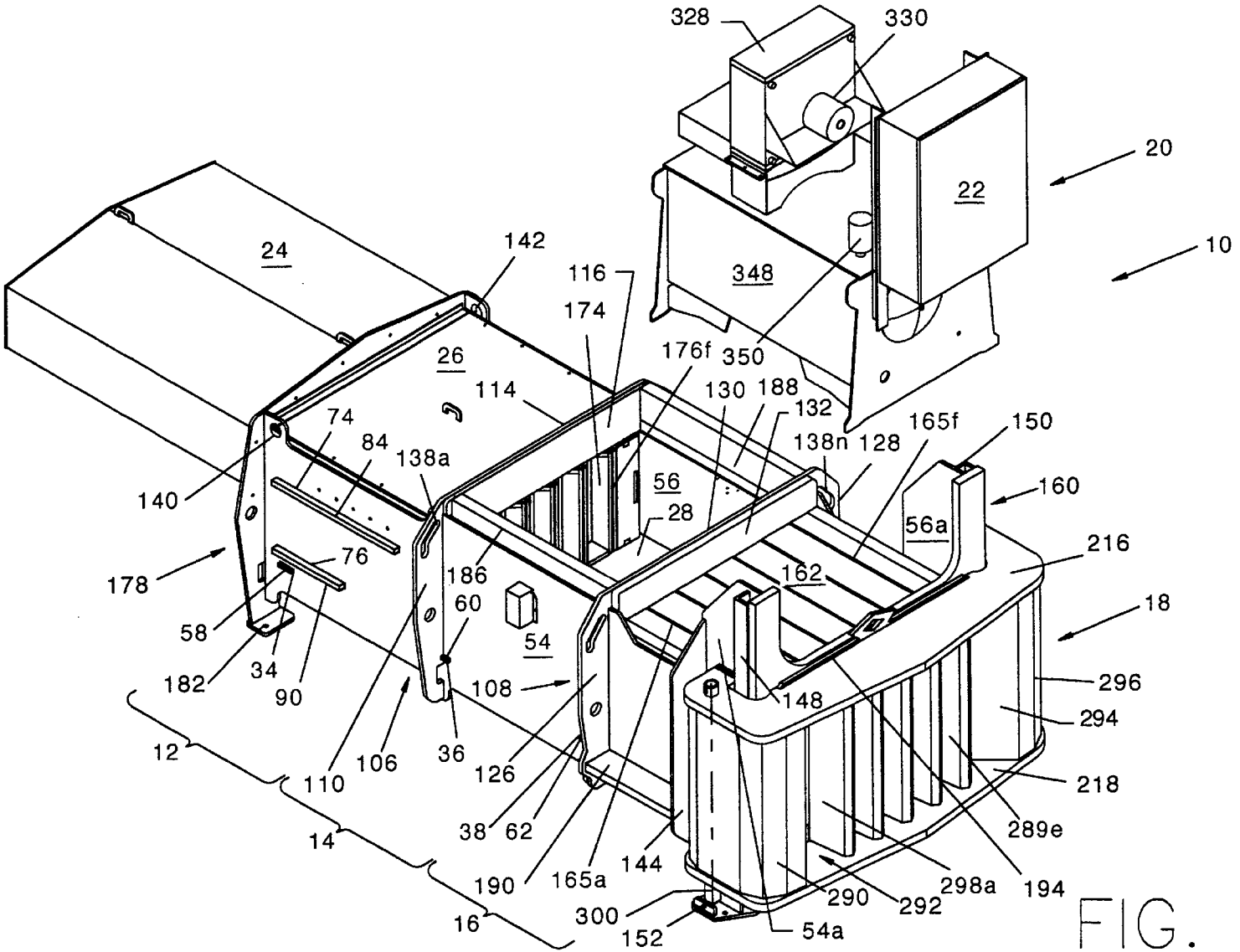
FIG. 1 illustrates an isometric view of the baler.

FIG. 1 illustrates an isometric view of a baler 10, the present invention, where the major illustrated components include a mechanical chamber 12 aligned contiguously with a charge or gather chamber 14, a bale chamber 16, a vertically positionable bale chamber door 18, a hydraulic power unit 20, an electrical control panel 22 mounted to the hydraulic power unit 20, a ram cover 24 secured to one end of the mechanical chamber 12, and a gather chamber cover 26 aligned to the top of the mechanical chamber 12.

Figure 2:
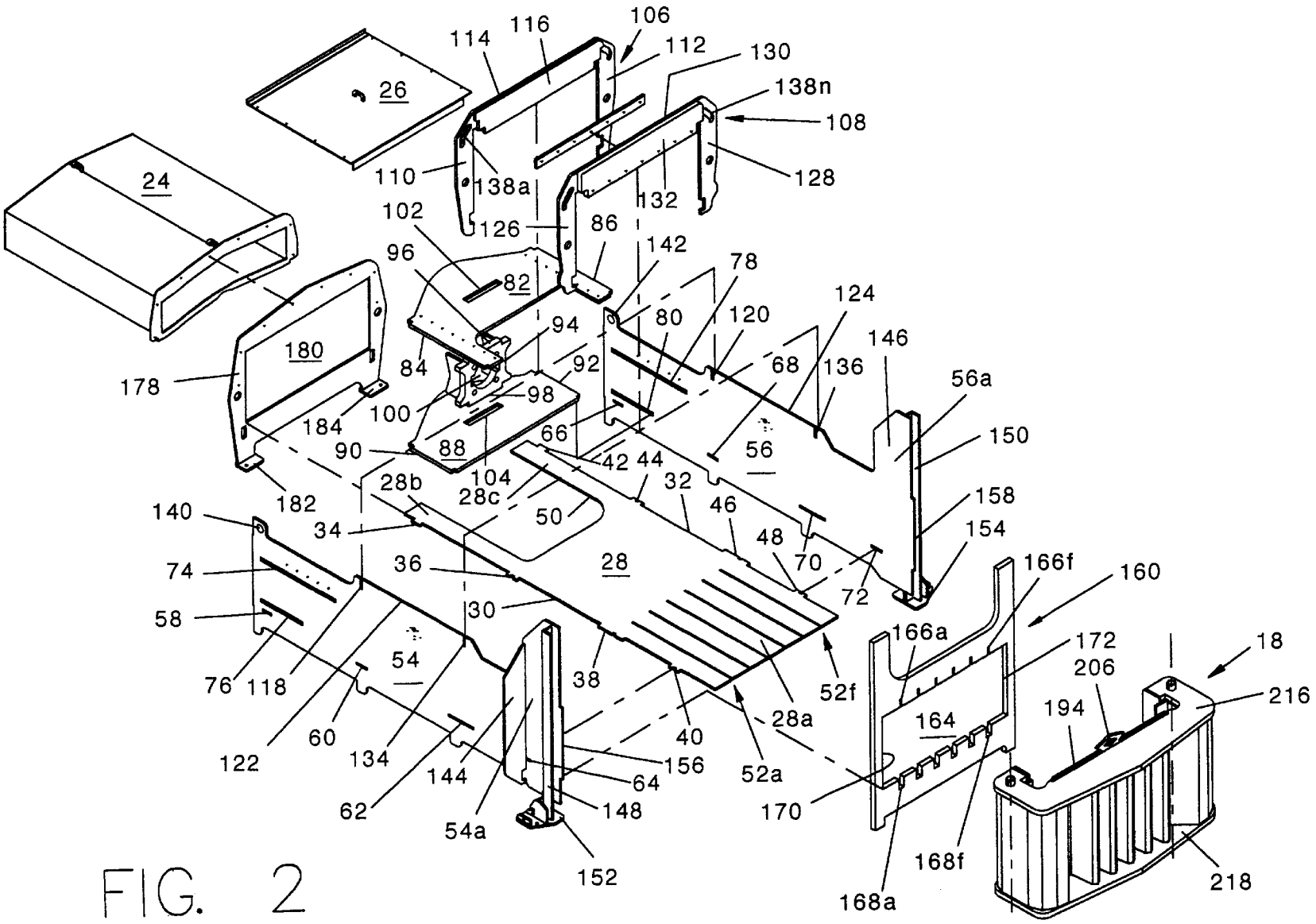
FIG. 2 illustrates an exploded view of the major planar components of the baler.
Figure 3:
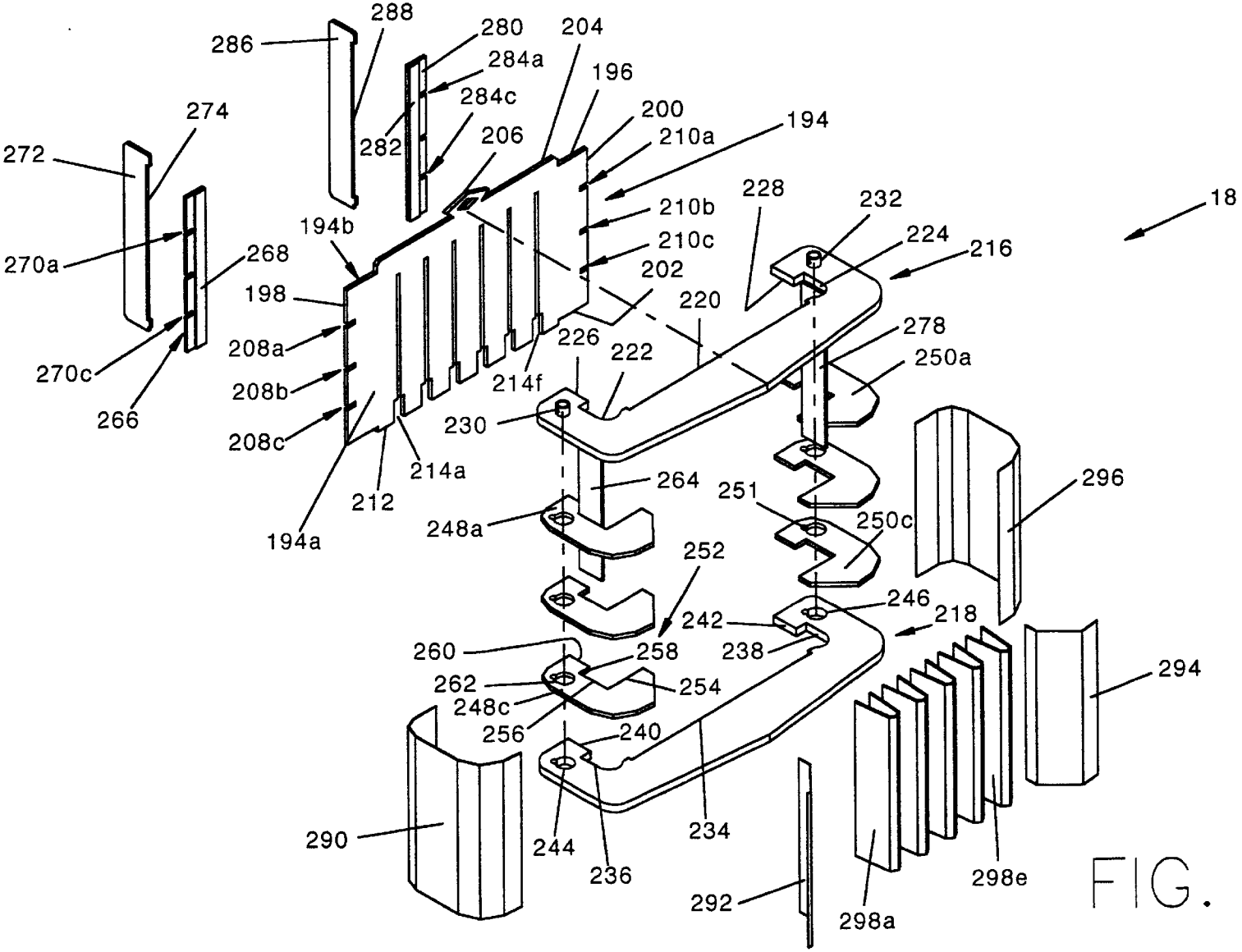
FIG. 3 illustrates an exploded view of the bale chamber door.
Figure 9:
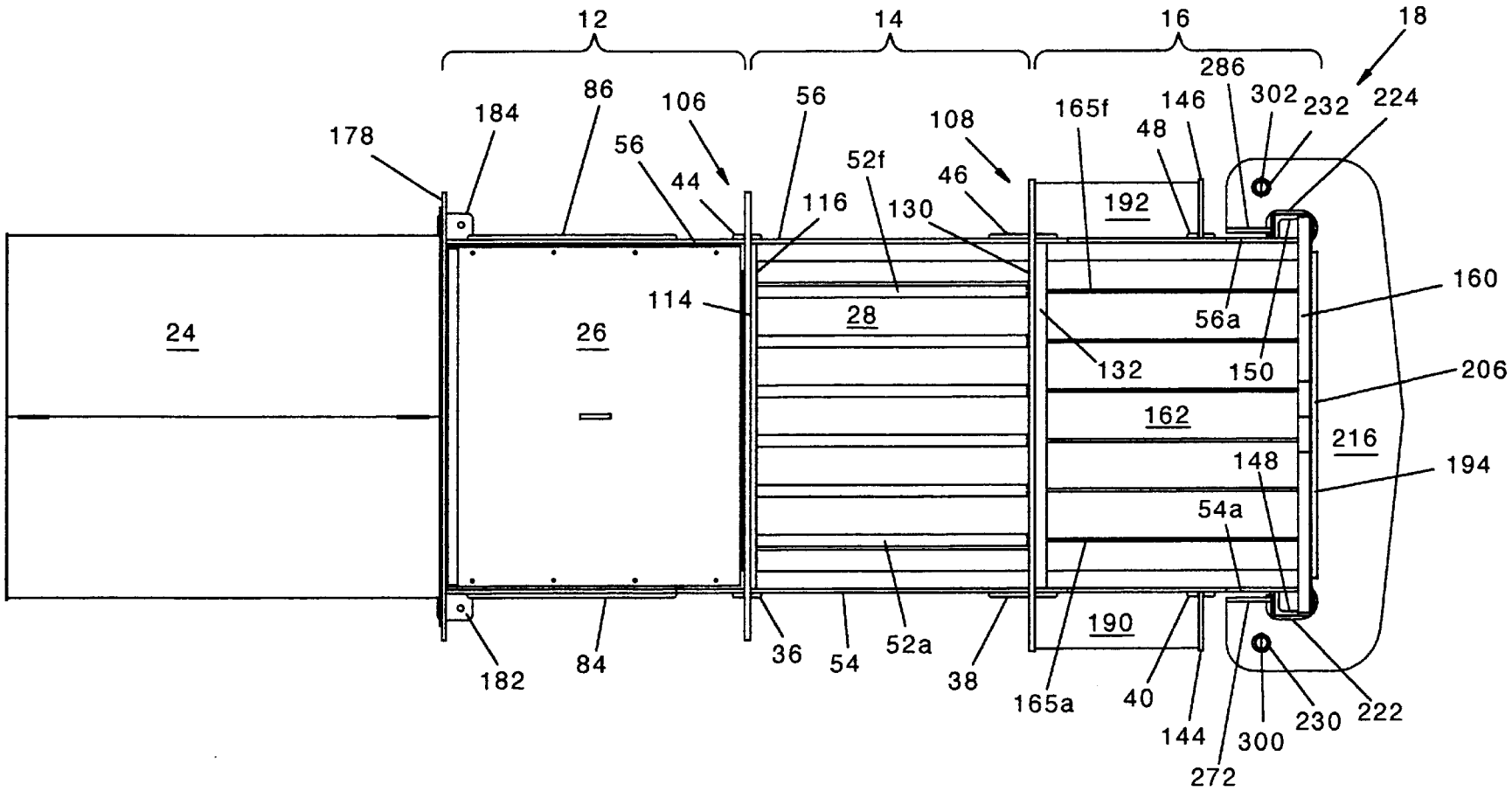
FIG. 9 illustrates a top view of the baler.

Structural integrity and alignment of the baler 10 is maintained by the use of heavy gauge steel plate, and the incorporation of interlocking devices and reinforcing members which are welded or otherwise secured throughout and within to bind and reinforce large planar plate members. In addition, the interlocking tabs and corresponding slots are cut precisely. The precise cutting is also a very important part of the fabrication process in that alignment jigs and other external support devices are not required because the tabs and slots are so precisely cut that their close fitting relationship causes the component members to be self-aligning and to locate without external jig or other support. Thus, a great deal of time and effort are saved during fabrication. With reference to FIG. 1 and/or FIG. 2, the main structure is now described in detail. A variety of components center about and build upon a horizontally aligned and configured essentially rectangular-shaped base plate 28 of FIG. 2. The planar base plate 28 includes opposing edges 30 and 32 having a plurality of tabs, including tabs 34, 36, 38 and 40, some of which are notched, projecting from edge 30, and corresponding tabs 42, 44, 46 and 48, some of which are notched, projecting from edge 32. A larger U-shaped cutout 50 is located at one end of the base plate 28. A plurality of slots 52*a*–52*f* are located at the opposing end of the base plate 28 to accommodate wire ties. Configured planar sides 54 and 56 align in a perpendicular fashion to the base plate 28 in an interlocking manner. Side plate 54 includes a plurality of horizontally oriented slots 58, 60, 62 and 64 which positionally correspond to tabs 34, 36, 38 and 40 on the base plate 28. Side plate 56 includes a plurality slots 66, 68, 70 and 72 which positionally correspond to tabs 42, 44, 46 and 48 on the base plate 28. Side 54 also includes horizontally aligned upper and lower slots 74 and 76 near one end, as illustrated, and side 56 includes horizontally and correspondingly aligned upper and lower slots 78 and 80. A horizontally aligned upper stringer 82 includes horizontally aligned and opposing tabs 84 and 86 which align in upper slots 74 and 78 of the side members 54 and 56 respectively. A horizontally aligned lower stringer 88 includes horizontally aligned and opposing tabs 90 and 92 which align in lower slots 76 and 80 in side members 54 and 56 respectively. A ram support bracket 94 includes horizontally aligned and opposing upper and lower tabs 96 and 98 and a central alignment hole 100. Upper and lower tabs 96 and 98 of the ram support bracket 94 align and secure between a slot 102 in the upper stringer 82 and a slot 104 and the base plate 28 respectively. Support is offered across the charge or gather chamber 14 and a portion of the bale chamber 16 and between the side members 54 and 56 by reinforced inverted U-shaped cross stringers 106 and 108. One such cross stringer 106 is illustrated having opposing vertical members 110 and 112, a horizontal bridge member 114 and a reinforcing plate 116 secured to the bridge member 114. The vertical members 110 and 112 of the cross stringer 106 align perpendicularly to and in vertical slot members 118 and 120 on the upper edges 122 and 124 of side members 54 and 56 and also align in the notches of the notched tabs 36 and 44 of the base plate 28 respectively. Cross stringer 108 is similar in construction and includes vertical members 126 and 128, horizontal bridge member 130 and reinforcement plate 132. The cross stringer 108 secures in vertical slot members 134 and 136 on the upper edges 122 and 124 of the side members 54 and 56 and also aligns in the notches of the notched tabs 44 and 46 of the base plate 28 respectively. A plurality of slotted hand holds 138*a*–138*n* are located in the upper regions of the cross stringers 106 and 108 which can also be utilized as attachment holes for lifting of the baler 10, such as by an overhead crane system. Attachment holes 140 and 142 are also included on side members 54 and 56. Vertically oriented stiffener plates 144 and 146, also illustrated in FIG. 9 are located along the largest vertical portions and near the ends of side members 54 and 56 in close proximity to the bale chamber door 18. The inner edge of the stiffener plates 144 and 146 also align in the notched ends of the tabs 40 and 48 of the base plate 28 which extend through slots 64 and 72 in the side members 54 and 56. Vertically oriented stationary slide angle members 148 and 150 are also located along the largest vertical portion 54*a* and 56*a* of the side members 54 and 56 in close proximity to the bale chamber door 18. Feet 152 and 154 secure to the bottom of the stationary slide members 148 and 150. Feet 152 and 154 also serve as an anchoring bracket for hydraulic door actuating cylinders illustrated in FIGS. 6, 7 and 10. Vertically oriented tabs 156 and 158 extend from the vertical side member portions 54*a* and 56*a* respectively. A heavy gauge front end plate 160 aligns to the vertical side member portions 54*a* and 56*a*, to the end portion 28*a* of the base plate 28 and also to a planar bale chamber top member 162 having a plurality of wire slots 165*a*–165*f* illustrated in FIGS. 1 and 9. The front end plate 160 includes a rectangular cutout 164 having a plurality of slots 166*a*–166*f* along the top horizontal edge of the cutout 164 and a plurality of slots 168*a*–168*f* along the bottom horizontal edge of the cutout 164. Vertical rectangle edges 170 and 172 align over and about the tabs 156 and 158 extending from the side members 54 and 56 respectively. A configured platen 174 includes a plurality a vertically aligned wire slots 176*a*–176*f*. Bale chamber 16 is formed by the bale chamber top 162, portions of the side members 54 and 56, and of the base plate member 28 extending generally from the cross stringer 108 to the front end plate 160 and by the members of the bale chamber door 18. Wire slots 52*a*–52*f*, 166*a*–166*f*, 168*a*–168*f*, and wire slots 165*a*–165*f* and wire slots 214*a*–214*f* of FIG. 3 are in mutual alignment about the bale chamber 16. A configured rear end plate 178 includes a rectangular cutout 180 which accommodates the rear portion members 28*b* and 28*c*. The rear end plate 178 is also a mount for the ram cover 24 and also includes feet members 182 and 184. The charge or gather chamber 14 is formed by the mid-portion of the base plate 28, and the mid-portions of the side members 54 and 56. Reinforcement plates 186 and 188 extend between the reinforcement plate 116 and the bridge member 130 to reinforce the upper region of the charge or gather chamber 14. A horizontally oriented reinforcement plate 190 extends along the lower region of side member 54 and between stiffener plate 144 and the vertical member 126 of the cross stringer 108. Correspondingly, another horizontally oriented reinforcement plate 192, illustrated in FIG. 9, extends along the lower region of side member 56 and between the stiffener plate 146 and the vertical member 128 of the cross stringer 108. All tab members extending from any stringers, sides or other members which are aligned in the appropriate slot members or cross stringer members are welded to insure structural integrity.

FIG. 3 illustrates an exploded isometric view of the vertically sliding reinforced bale chamber door 18 where all numerals correspond to those elements previously described.

Figure 4:
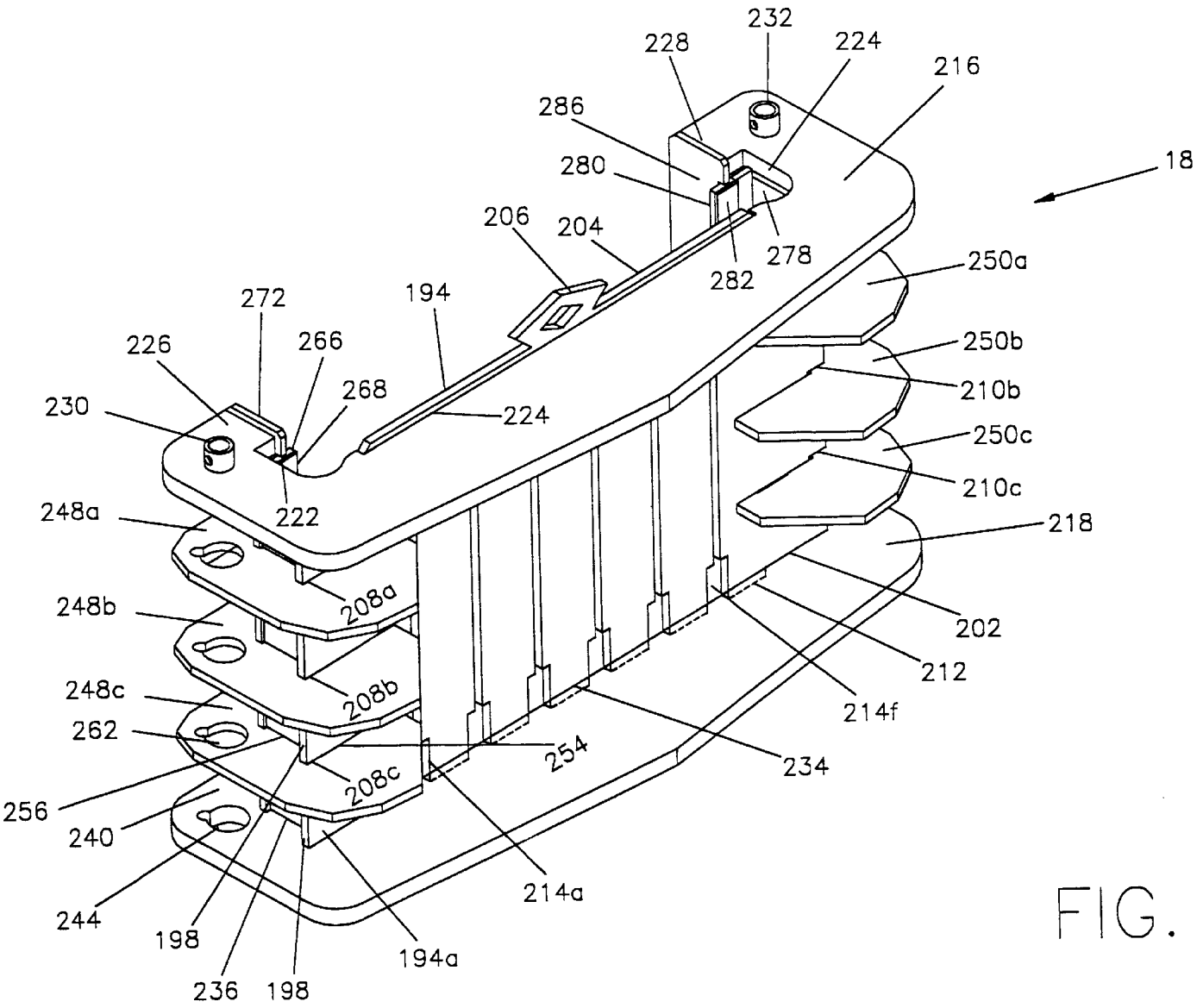
FIG. 4 illustrates an assembled view of the bale chamber door with the covers removed.

FIG. 4 illustrates an isometric view of an assembled vertically sliding reinforced bale chamber door 18 where all numerals correspond to those elements previously described.

With reference to FIGS. 3 and/or 4, the vertically sliding reinforced bale chamber door 18 is now described. A variety of components assemble about a configured door guide front plate 194 having a top edge 196, side edges 198 and 200, and a bottom edge 202. A tab 204 and a lug 206 extend upwardly from the top edge 196. A plurality of horizontally aligned slots 208*a*–208*c* are located along side edge 198 and a plurality of horizontally aligned slots 210*a*–210*c* are located along side edge 200. A tab 212 extends downwardly from the bottom edge 202. Tab 212 is interrupted by a plurality of vertically aligned dual width slots 214*a*–214*f* extending upwardly from tab 212 into the main planar area of the door guide front plate 194.

Upper and lower horizontally aligned U-shaped stringers 216 and 218 align and secure to the door guide front plate 194. The upper stringer 216 includes a slot member 220 along the area corresponding to the bottom of a U-shaped, opposing cutouts 222 and 224 flanking the slot member 220, and end members 226 and 228 aligned perpendicular to the slot member 220 and adjacent to cutouts 222 and 224. Hydraulic cylinder mounts 230 and 232 are located adjacent to the end members 226 and 228 respectively and over access holes in the end members 226 and 228. The lower stringer 218 is similar in shape and includes a slot member 234, opposing cutouts 236 and 238 flanking the slot member 234 and end members 240 and 242 aligned perpendicular to the slot member 234. Holes 244 and 246 are located adjacent to the end members 240 and 242 respectively to accommodate hydraulic actuating cylinders. A plurality of horizontally aligned reinforcement plates 248*a*–248*c* oppose mirror image-like plurality of horizontally aligned reinforcement plates 250*a*–250*c*. One such reinforcement plate 248*c* is now described. Reinforcement plate 248*c* is essentially C-shaped and includes a plurality of interiorly located adjacent edge surfaces which form a slot 252 including edge surfaces 254, 256 and 258. An edge surface 260 is located adjacent to edge surface 258. Slots 222 and 236 in the upper and lower stringers 216 and 218 correspond and align with the slots 252 in the reinforcement plates 248*a*–248*c*. A hole 262 is located adjacent to the surface edge 260 for accommodation of a hydraulic actuating cylinder. Reinforcement plates 250*a*–250*c* are mirror image-like duplicates of reinforcement plates 248*a*–248*c* and correspondingly align between opposing ends of the stringers 216 and 218, but are not described in detail for purposes of brevity and clarity.

The upper and lower stringers 216 and 218 and the plurality of reinforcement plates 248*a*–248*c* and 250*a*–250*c* align to the door guide front plate 194 and between stringers 216 and 218. The slot member 220 of the upper stringer 216 aligns to the tab member 204 of the door guide front plate 194 and slot member 234 of the lower stringer 218 aligns to the tab member 212 of door guide front plate 194. Edge 256 of each of the respective reinforcement plates 248*a*–248*c* align in slots 208*a*–208*c* and edges 254 of each of the respective reinforcement plates 248*a*–248*c* align to the outer planar surface 194*a* of the door guide front plate 194. A side slide plate 264 aligns and secures to edge surfaces 256 of each of the reinforcement plates 248*a*–248*c* and at the same time aligns perpendicular to the rear surface 194*b* of the door guide front plate 194 as further illustrated in FIG. 6. The side slide plate 264, at is upper end, abuts the lower surface of the top stringer 216 adjacent to the cutout 222. The side slide plate 264, at its lower end, abuts the upper surface of the bottom stringer 218 adjacent to the cutout 236. A rear slide plate 266 having a wear member 268 and a plurality of horizontally aligned slots 270*a*–270*c* aligns perpendicularly to the side slide plate 264. The door guide front plate 194, the side slide plate 264, and the rear slide plate 266, having been cut to precise close tolerances, together align in the manner just described within the close tolerance slots 252 of each reinforcement plate 248*a*–248*c* in slot and tab fashion in accordance to the teachings of the invention. A vertical reinforcement plate 272 having a slot 274 aligns to and secures to end members 226 and 240 of the upper and lower stringers 216 and 218, and to surface edges 260 of each of the reinforcement plates 248*a*–248*c*. The slot 274 aligns over and secures to the rear slide plate 266 which functions as a tab. The opposing ends of upper and lower stringers 216 and 218, reinforcement plates 250*a*–250*c*, a side slide plate 278, a rear slide plate 280 having a wear member 282 and a plurality of slots 284*a*–284*c* and a reinforcement plate 286 having a slot 288 align and secure to the door guide front plate 194 and to each other in a like, similar and corresponding fashion as that previously described. As illustrated in FIG. 1, side covers 290, 292, 294 and 296 align and secure between the stringers 216 and 218 and over and about the reinforcement plates 248*a*–248*c* and 250*a*–250*c* respectively. A plurality of V-shaped vertical door stiffeners 298*a*–298*e* align and secure between the stringers 216 and 218 and between the dual width slots 214*a*–214*f* of the door guide front plate 194.

Figure 5:
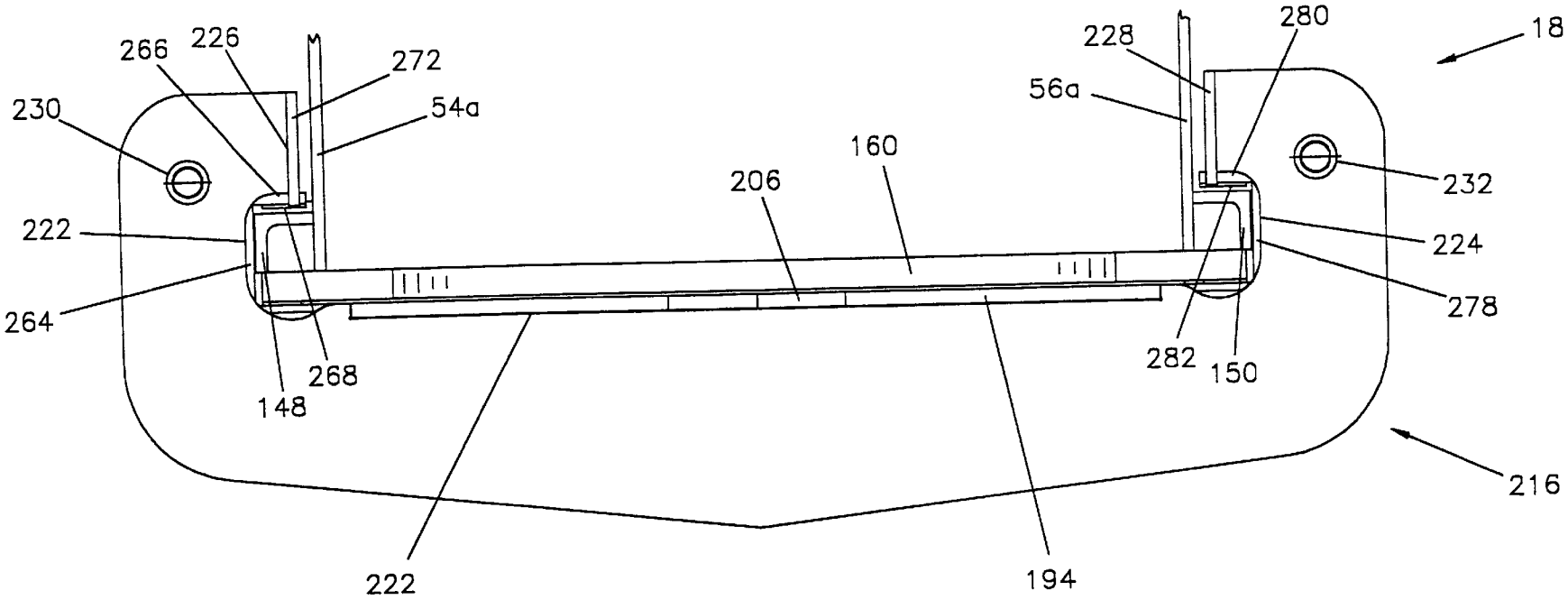
FIG. 5 illustrates a top view of the bale chamber door.
Figure 6:
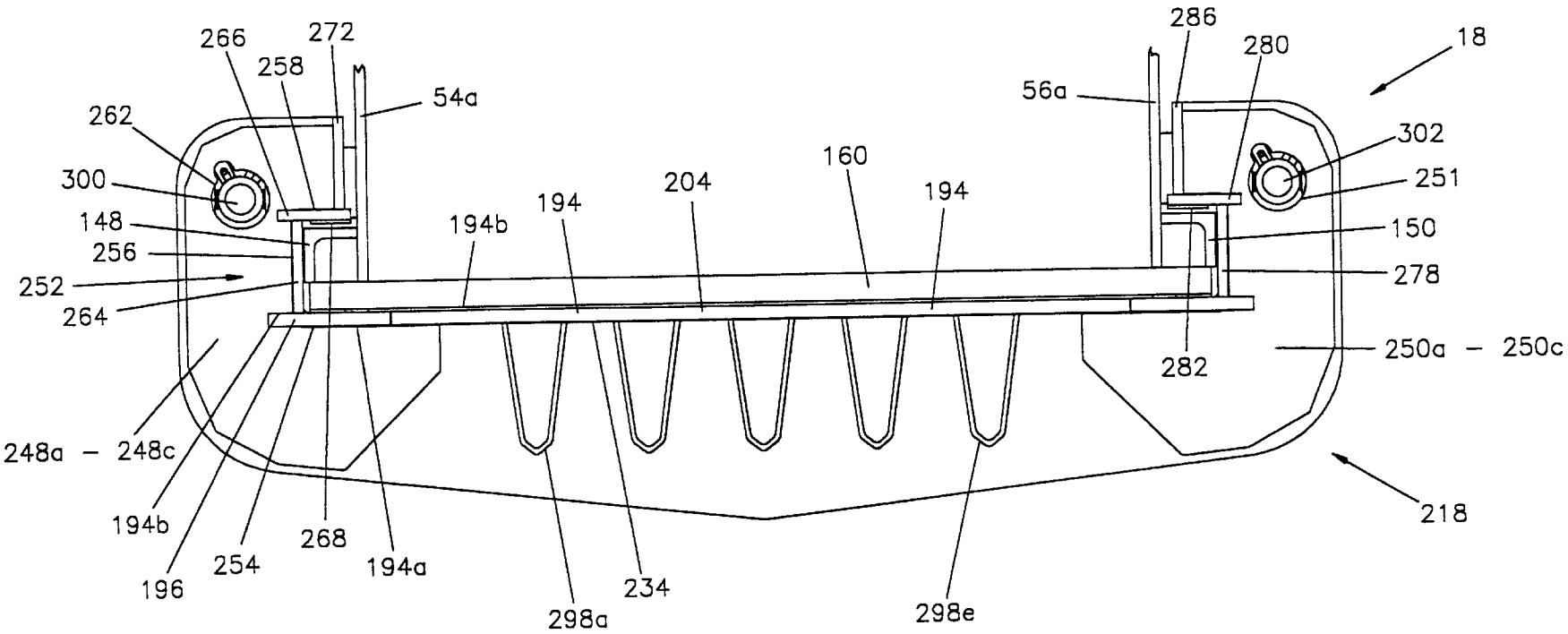
FIG. 6 illustrates a top view of the main structure of the bale chamber door with the top stringer and covers removed.

FIG. 5 illustrates a top view of the baler chamber door 18 where all numerals correspond to those elements previously described. Illustrated in particular in this FIG. and in FIG. 6 is the alignment of the stationary slide angle member 148 with side slide plate 264 and the rear slide plate 266 including wear member 268. The slide angle member 148 is secured, such as by welding, to the vertical side portion 54*a* and to the rear of the front end plate 160. Also shown is the alignment of stationary slide angle member 150 with side slide plate 278 and the rear slide plate 280, including wear member 282 which is secured, such as by welding, to the vertical side portion 56*a* and to the rear of the front end plate 160. Side slide plates 264 and 278 also slide against the vertical edges of the front end plate 160.

FIG. 6 illustrates a top view of the bale chamber door 18 with the covers and top stringer removed where all numerals correspond to those elements previously described. Rear slide plates 266 and 280, side slide plates 264 and 278, and the opposing vertical edges of the door guide front plate 194 align respectively in the slots 252 of the reinforcement plates 248*a*–248*c* and 250*a*–250*c*.

MODE OF OPERATION

Figure 7:
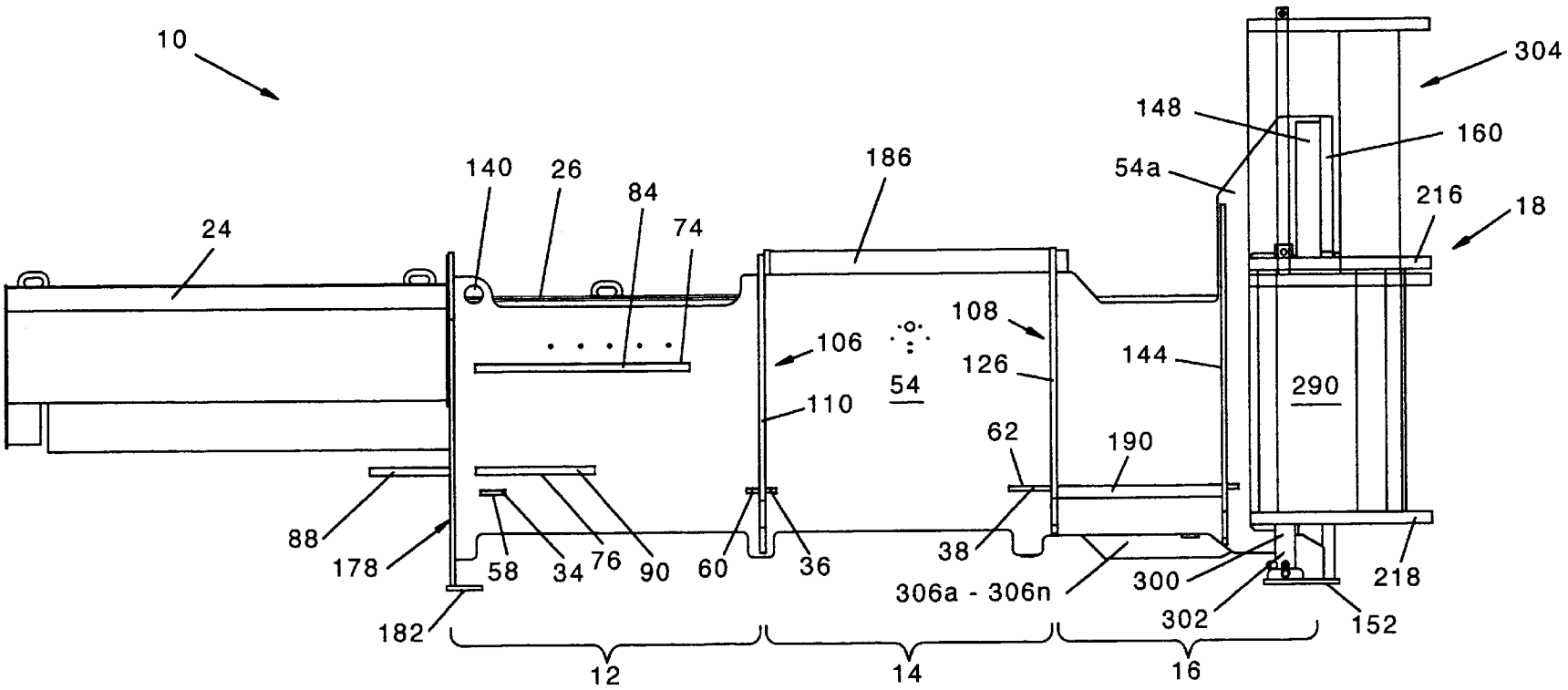
FIG. 7 illustrates a side view of the major components of the baler.
Figure 8:
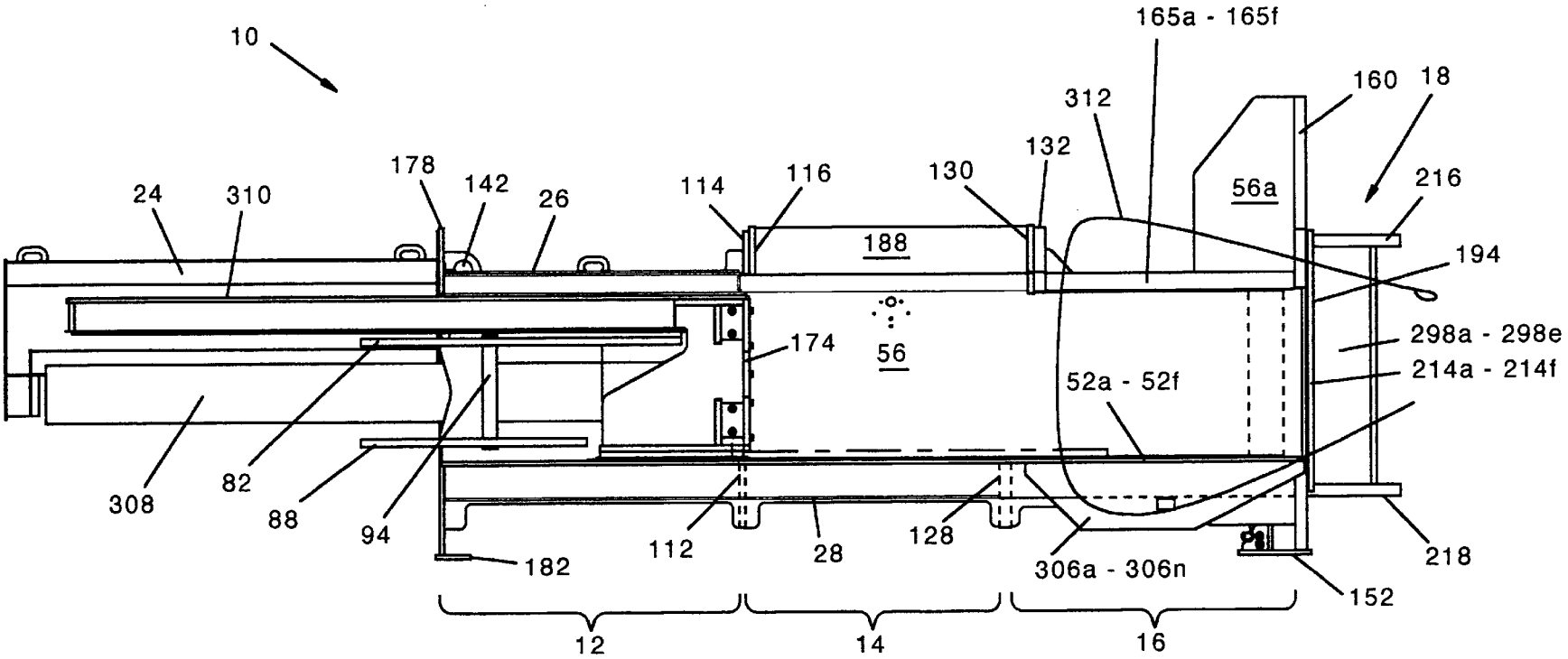
FIG. 8 illustrates a side view in cutaway of the baler.

FIG. 7 illustrates a side view of the baler 10 where all numerals correspond to those elements previously described. With reference to FIGS. 3, 5 and 7, hydraulic cylinder 300 secures on one end to the foot 152, extends through hole 244 in the lower stringer 218, through like holes 262 in each of the reinforcement plates 248*a*–248*c* and secures through the top stringer 216 to mount 230 on the top stringer 216. In a corresponding and like manner, a hydraulic cylinder 302 secures on one end of the foot 154, extends through hole 246 in the lower stringer 218, through like holes 251 in each of the reinforcement plates 250*a*–250*c* and secures through the top stringer 216 to mount 232 on the top stringer 216. Hydraulic cylinders 300 and 302 are actuated to vertically position the bale chamber door 18 to an elevated position shown in dashed lines. The platen 174 shown in FIG. 8 is hydraulically actuated to compress material in the bale chamber 16, and more specifically against the positionable bale chamber door 18. Subsequent to bale compression, the bale is bound by wire through appropriate wire slots. The bale chamber door 18 is then raised to allow the hydraulically powered platen 174 to eject the bale from the bale chamber 16. Also illustrated are a plurality of wire guide plates 306*a*–306*n* which align to the slots 52*a*–52*f* in the base plate 28.

Waste material is loaded into the charge chamber. A hydraulically powered platen on one end of the charge chamber pushes the waste material horizontally to the bale chamber where it is compressed into a bale. Wire ties are accessed through slots in the plate and the bottom plate of the bale chamber to bind the bale. The vertical door which forms one end of the bale chamber is raised via a hydraulic cylinder and the bale is ejected out of the bale chamber by the hydraulically powered platen.

FIG. 8 illustrates a side view in cutaway of the baler 10 where all numerals correspond to those elements previously described. The ram support bracket 94 is supported between upper and lower stringers 82 and 84 as previously described. A hydraulic cylinder 308 secures in the ram support bracket 94 and secures to the platen 174. Platen 174 is actuated to force material in the charge or gather chamber 14 into the bale chamber 16 for bale compression. A planar member 310 secures to the platen 174 and extends to the rear of the baler 10. Also illustrated is a typical bale wire 312 loaded in a corresponding slot in slots 214*a*–214*f*, 165*a*–165*f* and 52*a*–52*f*. Although the platen 174 is not illustrated in the advanced position, the bale wire 312 would also appropriately pass through slots 174*a*–174*f* in the platen 174 shown in FIG. 1.

FIG. 9 illustrates a top view of the baler 10 where all numerals correspond to those elements previously described.

Figure 10:
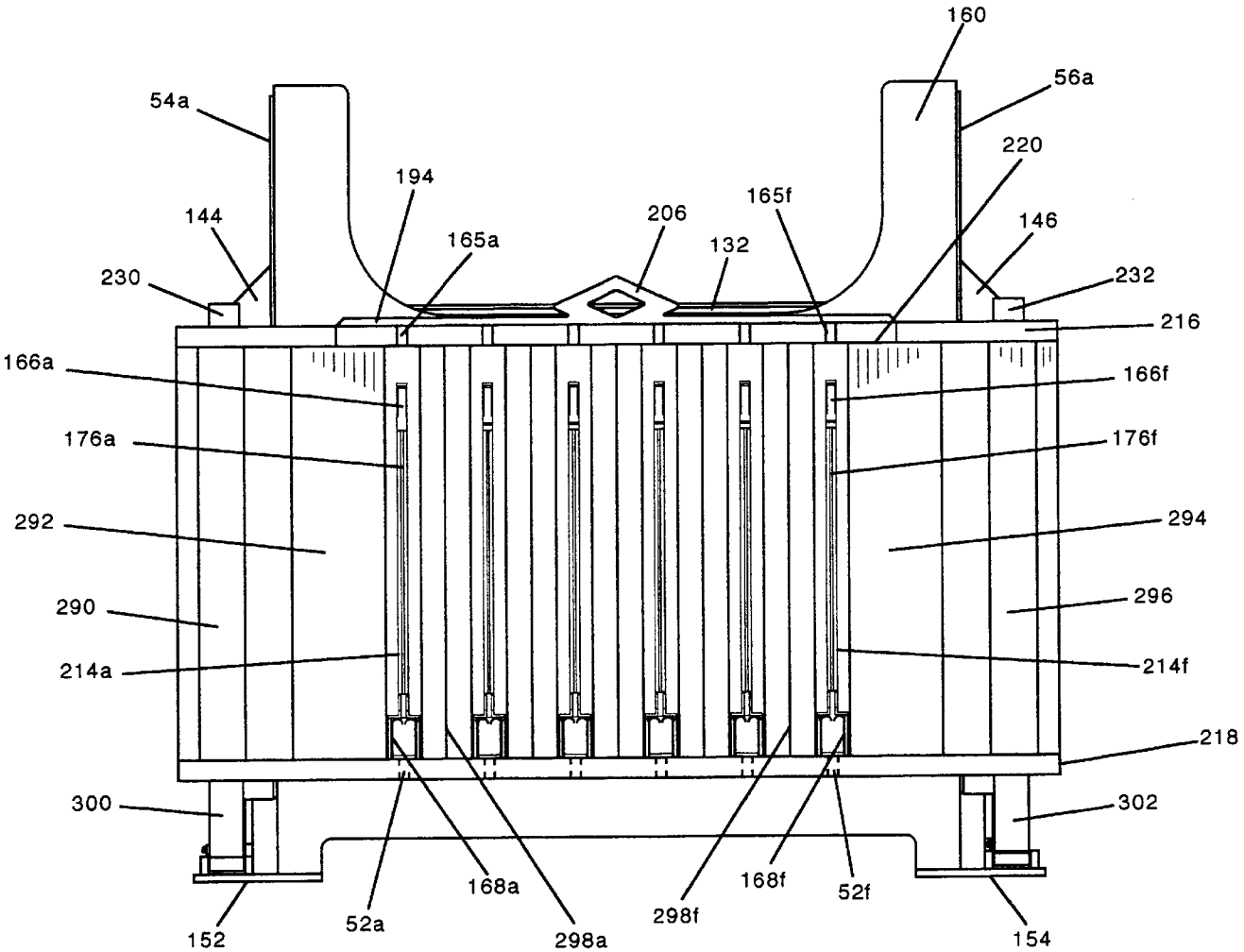
FIG. 10 illustrates a front view of the baler.

FIG. 10 illustrates a front view of the baler 10 where all numerals correspond to those elements previously described. Illustrated in particular is the alignment of slots 165*a*–165*f*, 166*a*–166*f*, 176*a*–176*f*, 168*a*–168*f* and 52*a*–52*f* which accommodate bale wires.

Figure 11:
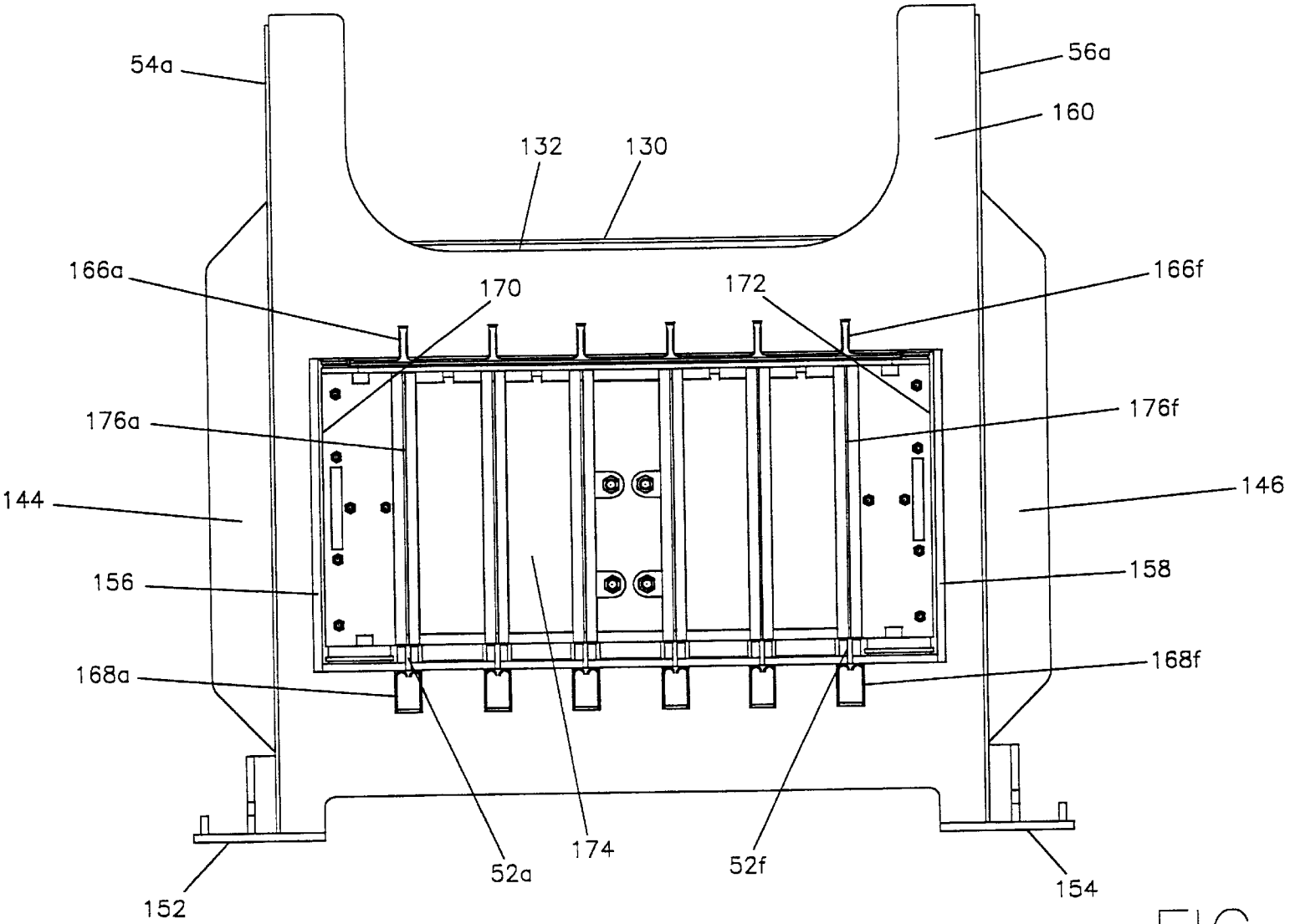
FIG. 11 illustrates a front view of the baler with the bale chamber door removed.

FIG. 11 illustrates a front view of the baler 10 with the bale chamber door 18 removed where all numerals correspond to those elements previously described.

Figure 12:
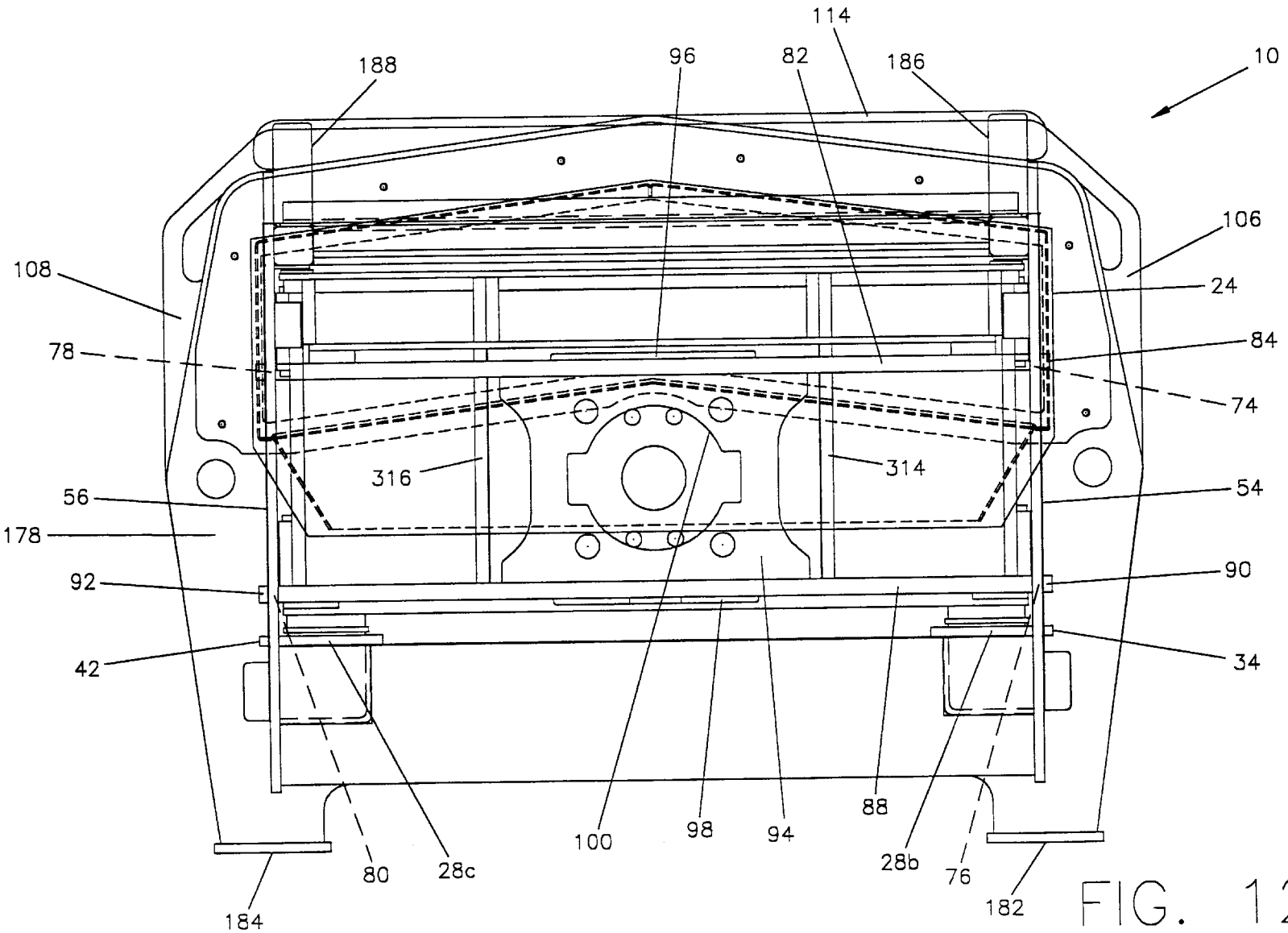
FIG. 12 illustrates a rear view of the baler.

FIG. 12 illustrates a rear view of the baler 10 where all numerals correspond to those elements previously described. Ram support bracket 94 is illustrated in tab and slot accommodation with upper and lower stringers 82 and 88. Vertical support members 314 and 316 closely flank the ram support bracket 94 and are aligned between the upper and lower stringers 82 and 88.

Figure 13:
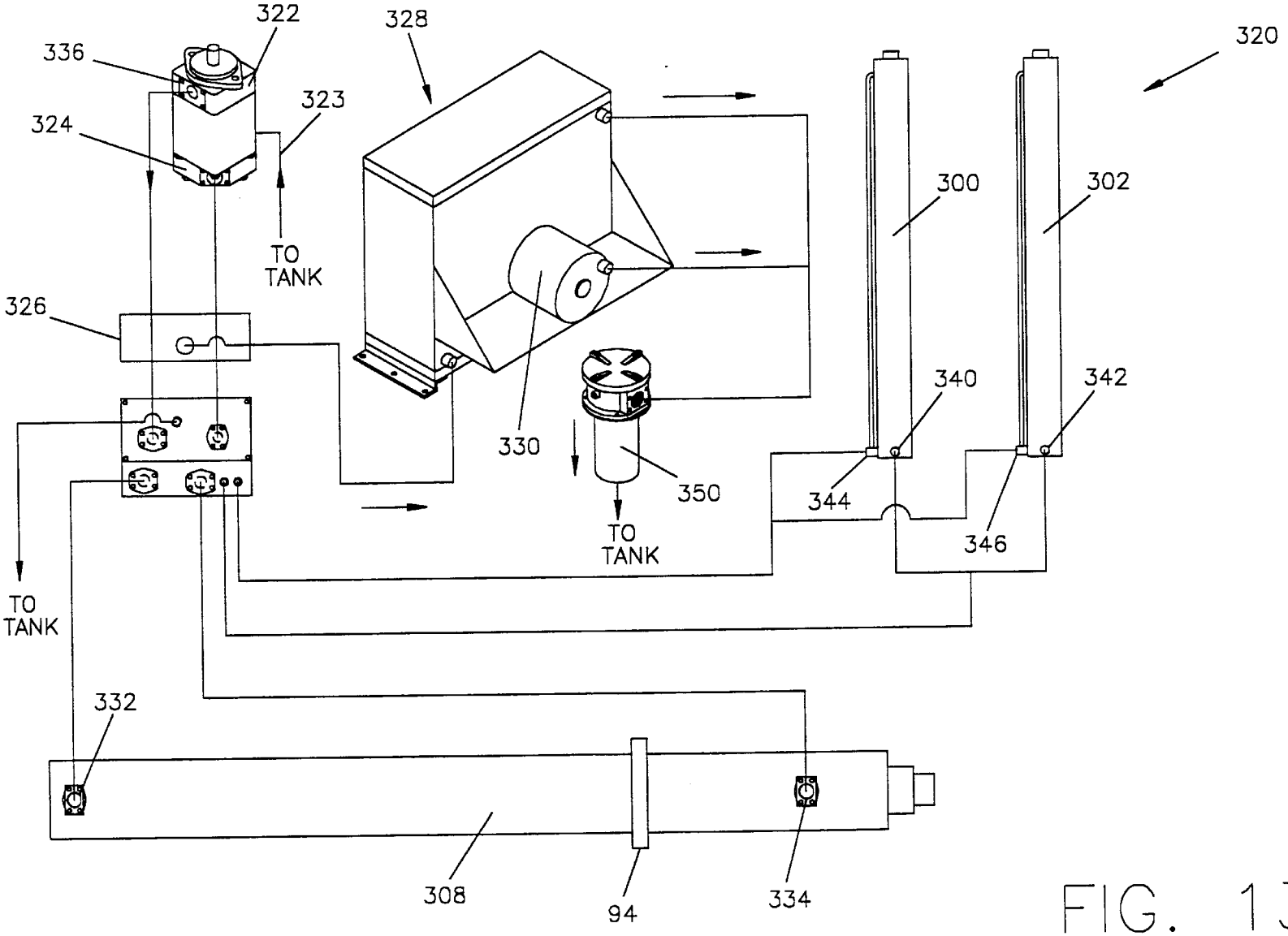
FIG. 13 illustrates a hydraulic schematic of the baler.

FIG. 13 illustrates a hydraulic schematic 320 for hydraulic operation of the baler 10 where all numerals correspond to those elements previously described. Included is a main motor 322 powering a pump 324, a pump input line 323, a control manifold 326, a cooling unit 328 having a cooling fan motor 330, a return filter 350 and an extend port 332 and retract port 334 located on the hydraulic cylinder 308. A low pressure high volume pump output port 336 provides hydraulic power to the extend and retract ports 332 and 334 of the hydraulic ram cylinder 318 through the control manifold 326. A high pressure low volume pump output port 336 provides hydraulic power to extend ports 340 and 342 and also to retract ports 344 and 346 of the door hydraulic cylinders 300 and 302 for raising of the bale chamber door 18. Hydraulic fluid is also ported from the manifold 326 for dual path cooling through the cooling unit 328 and is returned to a hydraulic tank 348, illustrated in FIG. 1, through return filter 350.

Figure 14:
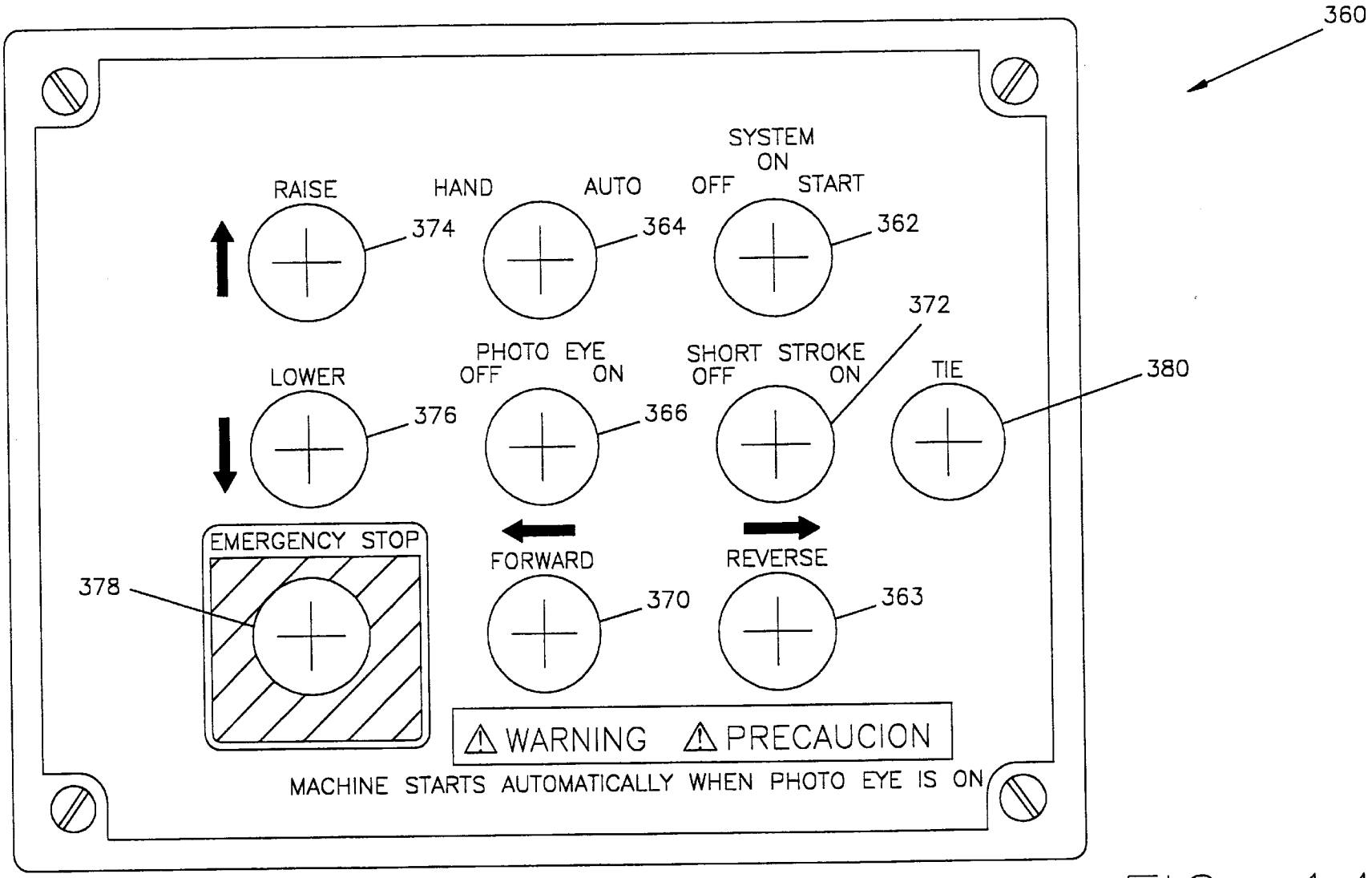
FIG. 14 illustrates an operator's control panel.

FIG. 14 illustrates an operator's control panel 360 for operation of the baler 10 where all numerals correspond to those elements previously described. Included are a control switch 362 for turning on the electrical circuitry of FIGS. 16 and 17A–17B and for starting of the motor 322 which powers the hydraulic pump 324. Control switch 362 selects automatic or hand operation of the ram hydraulic cylinder 308 in conjunction with a photo eye control switch 366 which selects a photo eye system. Control switches 368 and 370 are for reverse or forward operation of the ram hydraulic cylinder 308. Control switch 372 selects a short stroke for the ram hydraulic cylinder 308. Control switches 374 and 376 provide for raising or lowering of the bale chamber door 18. An emergency stop control switch 378 is also provided. A tie light 380 is also provided indicating that the bale is of sufficient size to apply baling wire.

Figure 17A:
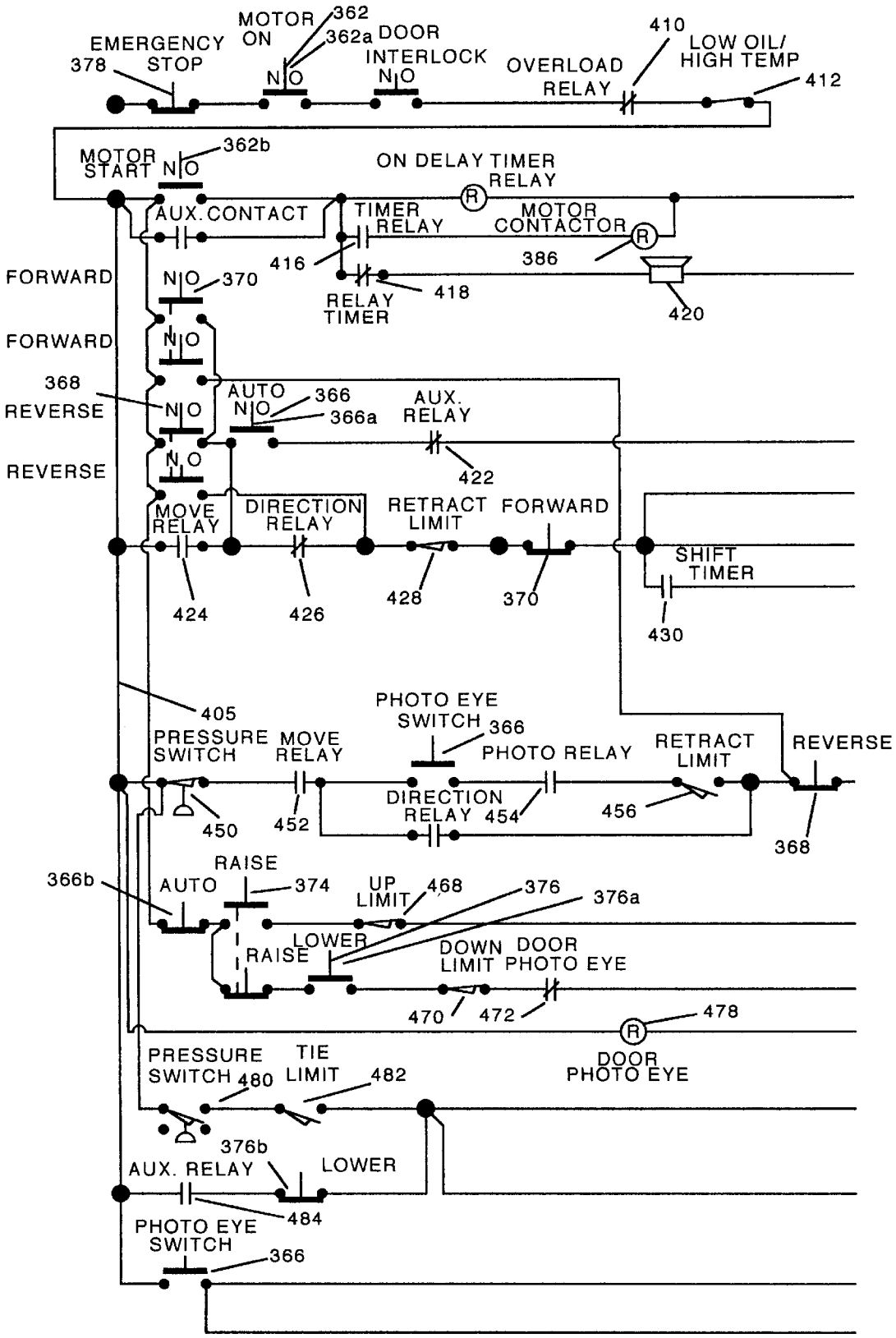
Figure 17B:
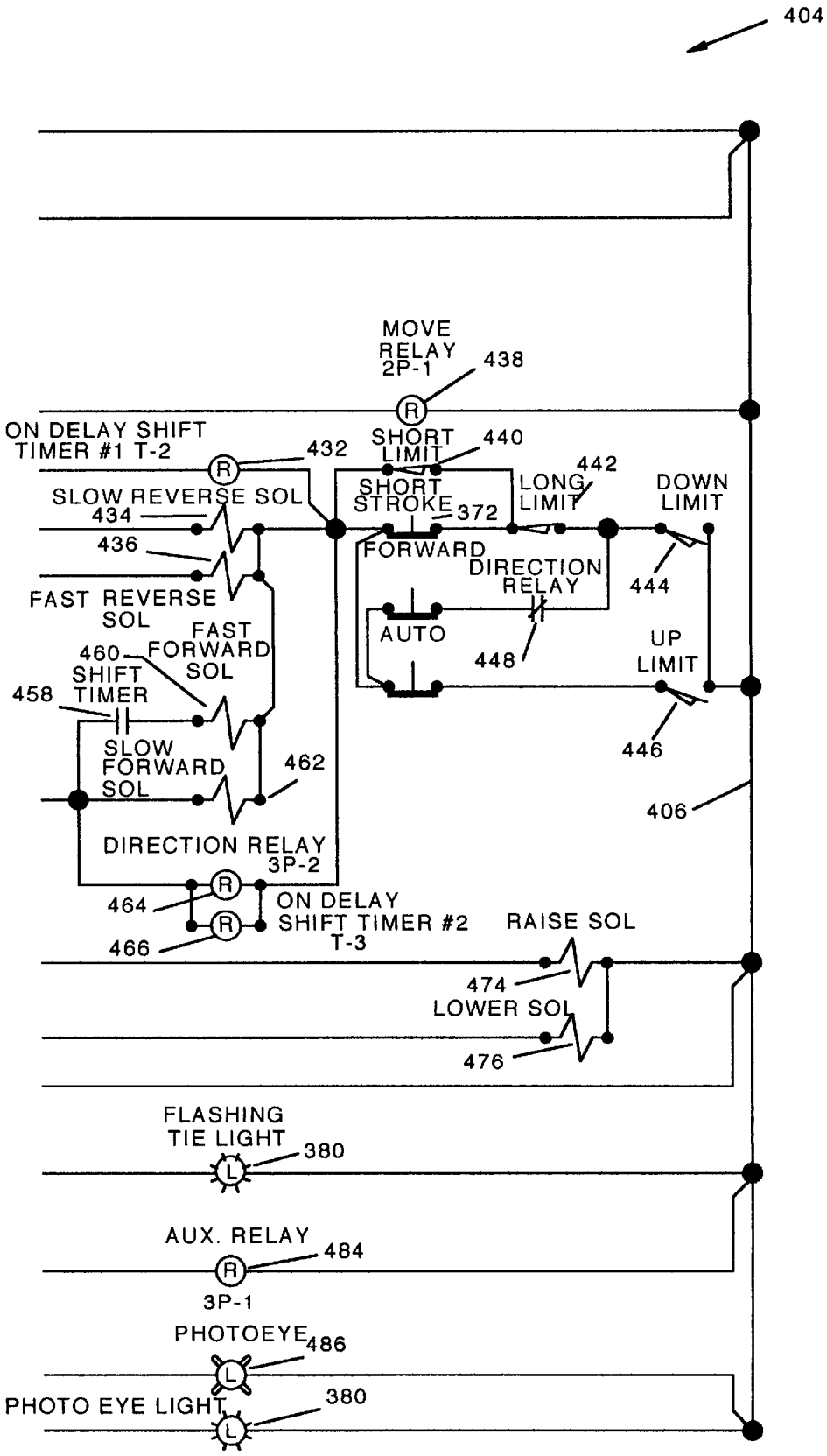

FIG. 15 illustrates the alignment of FIGS. 17A and 17B.

Figure 16:
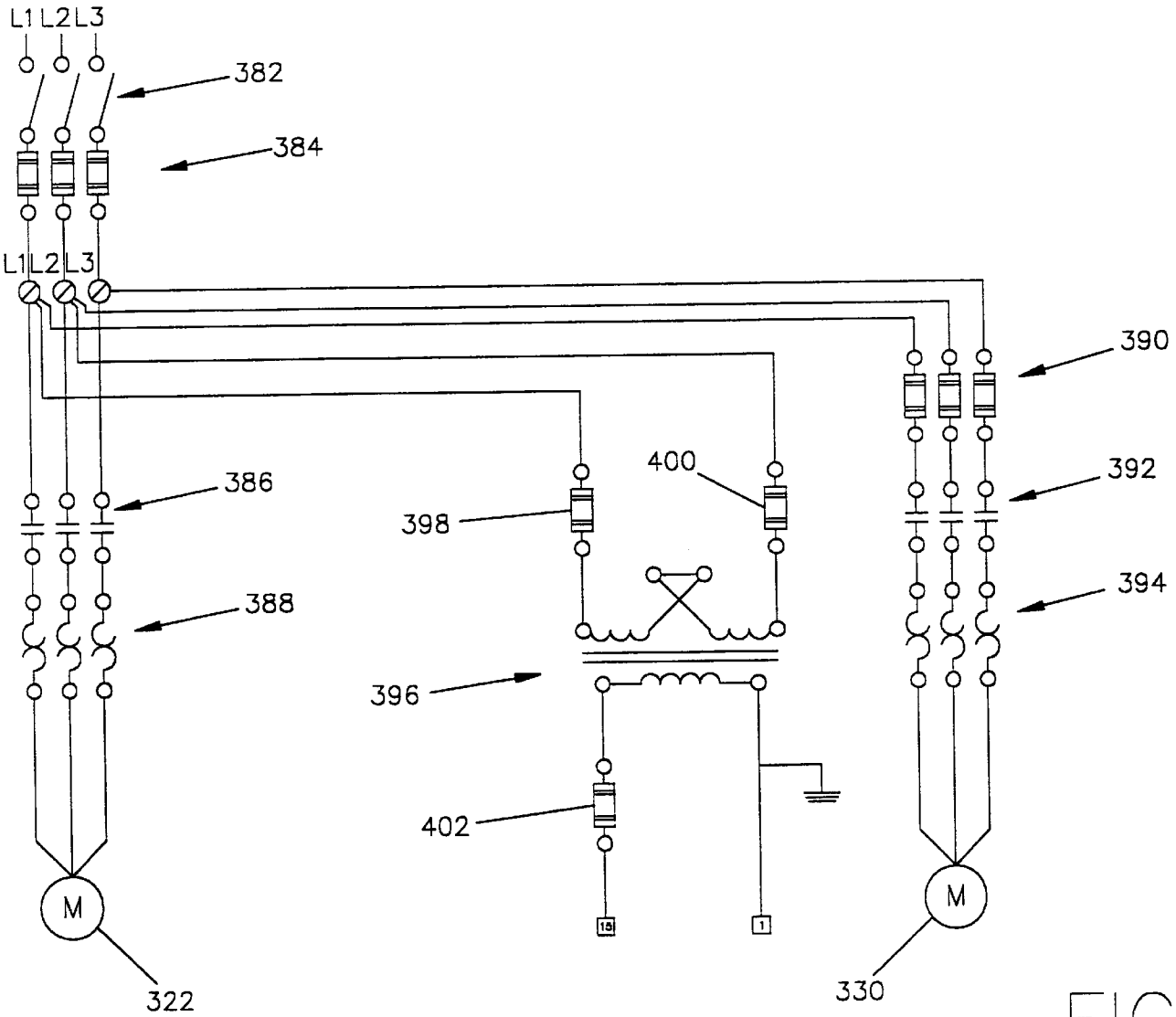
FIG. 16 illustrates electrical distribution for the main motor and cooler motor; and, FIGS. 17A–17B illustrate the electrical control circuitry for the baler.

FIG. 16 illustrates electrical power distribution for the main motor 322 and the cooler motor 330 where all numerals correspond to those elements previously described. Included in the power distribution leading to the main motor 322 are a source disconnect 382, a plurality of fuses 384, a plurality of motor contactors 386, and a plurality of overload devices 388. The cooler motor 330 receives power from the fuses 384, a plurality of fuses 390, motor contactors 392, and overload devices 394. Other power for various lower power requirements are received through a transformer 396 having input fuses 398 and 400 and an output fuse 402.

FIGS. 17A–17B illustrate the control circuitry 404 for operation of the baler 10 where all numerals correspond to those elements previously described. A variety of components connect between electrical supply lines 404 and 406. Included are the emergency stop switch 378, the motor on/start switch 362 which includes the "on" contactors 362*a* and the "start" contactors 362*b*, a door interlock contactor 408, overload relay 410, and a low oil/high temp contactor 412 which supply electrical power to an "on" delay timer relay 414, a timer relay 416, motor contactors 386, a timer relay 418 and a warning horn or buzzer 420 and other portions of the control circuitry 404. Also included is the ram forward control switch 370, the ram reverse control switch 368, the auto control switch 366 having members 366*a* and 366*b*, auxiliary relay 422, move relay 424, direction relay 426, retract limit switch 428, forward control switch 370, shift timer 430, "on" delay shift timer 432, slow reverse solenoid 434, fast reverse solenoid 436, move relay 438, a short stroke limit switch 440, short stroke control switch 372, a long stroke limit switch 442, a down limit switch 444, a direction relay 448, a pressure switch 450, a move relay 452, photo eye switch 366, photo eye relay 454, retract limit switch 456, reverse control switch 368, a shift timer 458, fast forward solenoid 460, slow forward solenoid 462, a direction relay 464, raise control switch 374, a lower control switch 376 including members 376*a*–376*b*, an up limit switch 468, a down limit switch 470, a door photo eye 472, a door photo eye 478, a pressure switch 480, a tie limit switch 482, flashing tie light 380, auxiliary relay 484, photo eye switch 366, photo eye 486 and photo eye 380.

Various modifications can be made to the present invention without departing from the apparent scope hereof.

We claim:

1. A baler for compression and baling of waste material comprising:

a. a charge chamber for receiving waste material comprising:

(1) two side plates with a plurality of tabs extending from top and bottom edges of said side plates and a plurality of slots extending through said side plates to provide sites for attachment;

(2) a base plate with tabs extending from side edges and which protrude through said slots in said side plates to provide sites for attachment of said side plates with said base plate;

(3) a charge chamber cover;

(4) a configured platen which forms a movable end cross section to said charge chamber; and, (5) an open other end cross section which provides an exit for said waste material from said charge chamber;

b. a bale chamber for containing said waste material during compression comprising:

(1) two side plates which are common to those of said charge chamber with tabs extending from top and bottom edges of said side plates and a plurality of slots extending through said side plate to provide sites for attachment;

(2) a base plate that is common to that of said charge chamber with tabs extending from side edges and which protrude through said slots in said side plates to provide sites for attachment of said side plates with said base plate;

(3) a top plate;

(4) an open entrance end cross section which provides for entrance of said waste material from said charge chamber into said bale chamber; and, (5) a vertical door which forms the other end cross section of said bale chamber, said door providing exit for said waste material from said bale chamber;

c. a hydraulic ram which is attached to said configured platen of said charge chamber to forcibly move said platen through said charge chamber;

d. a hydraulic cylinder attached to said vertical door to move said vertical door upward providing exit for said waste material from said bale chamber; and, e. an electrical control panel to operate said hydraulic ram and said hydraulic cylinder.

2. A baler for compression and baling of waste material comprising:

a. a charge chamber for receiving waste material comprising:

(1) two side plates with a plurality of tabs extending from top and bottom edges of said side plates and a plurality of slots extending through said side plates to provide sites for attachment;

(2) a base plate with tabs extending from side edges and which protrude through said slots in said side plates to provide sites for attachment of said side plates with said base plate;

(3) a charge chamber cover;

(4) a configured platen which forms a movable end cross section to said charge chamber; and, (5) an open other end cross section which provides an exit for said waste material from said charge chamber;

b. a bale chamber for containing said waste material during compression comprising:

(1) two side plates which are common to those of said charge chamber with tabs extending from top and bottom edges of said side plates and a plurality of slots extending through said side plate to provide sites for attachment;

(2) a base plate that is common to that of said charge chamber with tabs extending from side edges and which protrude through said slots in said side plates to provide sites for attachment of said side plates with said base plate;

(3) a top plate;

(4) an open entrance end cross section which provides for entrance of said waste material from said charge chamber into said bale chamber; and, (5) a vertical door which forms the other end cross section of said bale chamber, said door providing exit for said waste material from said bale chamber;

c. a hydraulic ram which is attached to said configured platen of said charge chamber to forcibly move said platen through said charge chamber;

d. a hydraulic cylinder attached to said vertical door to move said vertical door upward providing exit for said waste material from said bale chamber;

e. an electrical control panel to operate said hydraulic ram and said hydraulic cylinder; and, f. a plurality of U-shaped encompassing support plates which add structural strength and rigidity to said baler, said support plates attaching to said plurality of tabs extending from said top and bottom edges of said side plates and attaching to said plurality of slots found in said side plates.

3. The device of claim 1 or 2, wherein said base plate located in said bale chamber includes a plurality of slots and said top plate of said bale chamber includes a plurality of slots to accommodate wire ties for tying the bale.

* * * * *